US005544598A

United States Patent [19]

Guibelin et al.

[11] Patent Number: 5,544,598

[45] Date of Patent: Aug. 13, 1996

[54] SYSTEM FOR INJECTING SLURRY TO BE INCINERATED INTO AN INCINERATION FURNACE, CORRESPONDING OPERATING PROCEDURE, USE AND FURNACE

[75] Inventors: Eric Guibelin, Livry-Gargan; Yves Valette, Orsay, both of France

[73] Assignee: OTV Omnium de Traitements et de Valorisation S.A., Saint Maurice Cedex, France

[21] Appl. No.: 377,713

[22] Filed: Jan. 23, 1995

[30] Foreign Application Priority Data

Jan. 26, 1994 [FR] France ..... 94 01050

[51] Int. Cl.[6] ..... F23G 7/04

[52] U.S. Cl. ..... 110/238; 110/260

[58] Field of Search ..... 110/260, 261, 110/262, 263, 264, 265, 238

[56] References Cited

U.S. PATENT DOCUMENTS

| | | | |
|---|---|---|---|
| 3,722,433 | 3/1973 | Kramer . | |
| 4,619,210 | 10/1986 | Kennedy | 110/255 |
| 4,728,036 | 3/1988 | Bennett et al. . | |
| 4,785,746 | 11/1988 | Roy et al. | 110/238 |
| 5,052,310 | 10/1991 | Goff et al. . | |
| 5,248,405 | 2/1994 | Carpenter | 110/238 |
| 5,297,496 | 3/1994 | Quaak et al. | 110/238 |

FOREIGN PATENT DOCUMENTS

| | | | |
|---|---|---|---|
| 1910450 | 9/1970 | Germany | 110/238 |
| 2303126 | 8/1973 | Germany | 110/238 |
| 57-182009 | 11/1982 | Japan . | |
| 59-77222 | 5/1984 | Japan . | |
| 59-142321 | 8/1984 | Japan . | |
| 66804 | 3/1973 | Luxembourg . | |
| 1165349 | 9/1969 | United Kingdom | 110/238 |
| 1411007 | 10/1975 | United Kingdom . | |
| 1544697 | 4/1979 | United Kingdom . | |

*Primary Examiner*—Thomas E. Denion
*Attorney, Agent, or Firm*—Merchant, Gould, Smith, Edell, Welter & Schmidt, P.A.

[57] ABSTRACT

System for injecting slurry to be incinerated into an incineration furnace, the furnace having an incineration hearth onto which the household waste is tipped in order to be incinerated, and including a device for injecting the slurry to be incinerated into the furnace, essentially fitted above the incineration hearth in such a way as to allow the slurry to be fed to the hearth at least in part by gravity, the injection device being fitted with a spray device to spray the slurry when it is injected into the furnace, wherein the said injection device has an injection casing forming a spray chamber with a slurry feed intake, and a discharge nozzle, for injecting the slurry into the furnace, the said chamber being crossed by a pressurized air injection tube, the end of which is fitted with a diffuser in the area of the nozzle of the said chamber, the said injection casing being mounted onto a pivot and working together with a telescopic rod for adjusting the angle of the injection casing by rotation around the said pivot.

17 Claims, 3 Drawing Sheets

SYSTEM FOR INJECTING SLURRY TO BE INCINERATED INTO AN INCINERATION FURNACE, CORRESPONDING OPERATING PROCEDURE, USE AND FURNACE

BACKGROUND OF THE INVENTION

The scope of the invention relates to the elimination of slurry or some other pasty wastes such as fatty wastes, especially slurry from industrial processes or drinking water or used water filtering stations.

More precisely, the invention concerns a system for injecting slurry to be incinerated into an incineration furnace, together with a procedure and a corresponding furnace. The invention will have particular application in dual application furnaces for household waste (or other urban or industrial waste) and slurry and/or fatty wastes. It may be applied to furnaces with different types of combustion (for example, with a fixed or removable incineration hearth, with grids, rollers, fluid bed, etc . . .).

The slurry, in particular slurry which has come from dehydration plants at used water treatment stations, generally has a high content of organic material which is not easily biodegradable. It therefore poses environmental problems and should therefore be eliminated. Furthermore, due to the increasing number of water filtering plants, there is more and more slurry to be treated.

An initial, and already known solution to the elimination is to store same in a dump. However this solution, widely used in the past, is not ecologically acceptable and tends therefore not to be used.

A second, already known solution, including the reusing of this slurry for agricultural purposes would be an ideal solution. Unfortunately, the high costs of storage, transport, spreading and the very nature of the slurry often constitute major obstacles to the implementation of such a solution.

Finally, the third and last already known solution for eliminating slurry is incineration, which produces purely mineral waste. This solution would seem to be the one which is experiencing the most development at the moment. However, when such incineration is used on the filtering station site, using a specific furnace, it may be very costly. That is why when there is already an incinerator in close proximity to the filtering station, for example an incinerator originally intended for another use such as incinerating household waste, it may be economically viable to burn the slurry from the filtering station in the existing incinerator.

Despite the fact that this principle of incinerating household slurry mixed with other products to be incinerated—such as household waste—is already known, implementation of it however, poses several problems.

Thus, according to prior art, the injection of slurry into the combustion chamber of a household waste incineration furnace is generally carried out continuously, in the form of a slurry cylinder.

At the moment, when using this type of injection, the slurry does not disperse in the combustion chamber during injection and so combustion of it is not at its optimum. In other words, the content in the non-burned material of clinker and loose cinders resulting from incinerating the mixture of household waste/slurry may exceed the maximum values imposed in legislation (for example, a maximum of 5% of non-burned material in the clinker).

Additionally, the slurry is not evenly distributed throughout the household waste. There are therefore phenomena of under cooling or over heating in the combustion chamber, depending on whether the incinerated mixture contains a large or small quantity of slurry. These phenomena may disturb operation of the furnace, even cause combustion to stop.

Finally, the variable quality of the slurry to be incinerated, particularly as a function of the dry material which they contain and their calorific value, may also cause phenomena of over heating or under cooling which may cause the boiler to cut off.

SUMMARY OF THE INVENTION

A particular aim of the invention is to compensate for these various inconveniences in prior art.

More precisely, one of the aims of this invention is to supply a system for injecting slurry to be incinerated into an incineration furnace for mixed household waste and dehydrated slurry, this system avoiding shut down of the furnace due to the high temperature limits being exceeded (over heating) or to the low temperature limits being exceeded (under cooling).

Another aim of the invention is to supply such a system which will not increase the quantity of non burned material in the clinker, or the rate of non burned material in the loose cinders.

A further aim of the invention is to supply such a system which does not create significant new needs in terms of labour in the daily management of the furnace or even in relation to maintenance and care of the injection system itself.

An additional aim of the invention is to supply such a system which may be used with any type of furnace (including a furnace specifically designed for incinerating slurry), whilst ensuring optimum combustion of the slurry injected.

A further aim of the invention is to supply an optimum procedure for operating such a system.

These different aims, together with others which will be discussed later, are achieved using a system for injecting slurry or same other pasty wastes to be incinerated into an incineration furnace, the said furnace having an incineration hearth onto which the said household waste is tipped in order that it may be incinerated, the system having a device for injecting the said slurry, or other pasty wastes, to be incinerated into the furnace, which is basically located above the said incineration hearth in such a way as to allow the slurry to be fed to the said hearth at least in part by gravity, the said injection device being fitted with a device for spraying the slurry as it is injected into the furnace.

According to the invention, the injection device includes an injection casing forming a spray chamber into which the slurry is fed and a discharge nozzle to inject the slurry into the said furnace, the said chamber being crossed by a gas, such as air or steam, pressured injection tube, the end of which is fitted with a diffuser in the site of the nozzle on the said chamber, the pressurised gas injection tube working together with a device to displace the diffusion in relation to the diffusion nozzle on the chamber, in such a way as to provide adjustment of the slurry spray.

This device can be used to control backwards and forward motion of the injection tube in the spray chamber, in the event of the chamber being blocked with slurry.

Therefore, according to the invention, the slurry is broken down into droplets or slabs before being fed onto the incineration hearth. This is an important advantage, particularly when the incineration furnace is a dual purpose furnace used to incinerate something else, particularly household waste or other waste. In effect this causes optimum combustion of the slurry creating a large exchange surface and even distribution of the slurry on the waste already on the incineration hearth. This optimum combustion of the slurry, which does not disturb combustion of the waste, does not increase the content of the clinker and smoke in terms of non burned material. To achieve this, the droplets or slabs of slurry obtained by spraying should be neither too small nor too large. If they are too small they will be taken up into the combustion fumes too quickly and will increase the loose cinder content of the non burned material. If they are too large, their combustion time will be too long and this will disturb combustion and risk increasing the clinker content of the non burned material.

The proportion of injected slurry to waste, and the dryness of the slurry vary and are chosen in accordance with the situation in question, for example according to the availability of thermical energy, which may be to eliminate a maximum amount of slurry or to supply energy.

Furthermore, as the slurry is injected continuously and burns almost perfectly, it does not create any overheating or under cooling problems. In effect, it is sufficient that the mixture of waste and slurry remains spontaneously combustible.

In an advantageous mode of producing the invention, said incineration hearth has at least two separate successive zones, including a combustion zone and a finishing zone and said injection device is essentially located above the said combustion zone.

In an advantageous mode of producing the invention, the said incineration hearth shall have at least two separate successive zones, including a combustion zone and a finishing zone, the said means of injection essentially being located above the said combustion zone.

In these two modes of producing the invention, the slurry is spread on the zone(s) of the incineration hearth which will ensure optimum combustion of this slurry. In other words, the duration and the temperature must be adequate to ensure that following even distribution by spraying, the slurry is completely burned.

These two modes of producing the invention correspond to the most usual configuration of hearths in incineration furnaces used for household waste. Nevertherless, it is clear that the invention can be used with other furnaces, especially with furnaces whose hearths only have one combustion zone—for example, the case of small volume furnaces and/or operating on a 'batch' basis (via successive loads)—, or even more than three zones.

Advantageously, the said injection casing is mounted onto a pivot and working with at least a telescopic adjustment rod for adjusting the angle of the said injection by rotating around said pivot.

The adjustment of the slurry spray is generally carried out at the same time as the adjustment to the pressured injection to the spray device, these values being adjusted when starting the furnace.

Advantageously, the said injection tube is covered, at least partially, with a protective sleeve. This sleeve limits abrasion of the injection tube and prevents fibres from getting caught.

In this way, the path of the slurry droplets or slabs can be adjusted within the furnace. Thus, the system of the invention may be adapted to any type of furnace and the slurry may be injected in the right place, onto the hearth, in particular by avoiding projecting the slurry onto the walls of the combustion chamber.

Preferably, the said chamber should be fitted with a supply of cleaning fluid.

To its advantage, the said intake for the cleaning fluid is located in the area in which the slurry is fed in, in such a way as to enable the whole of the chamber to be cleaned prior to evacuating the cleaning fluid by the injection nozzle.

To its advantage, the system has means of controlling the internal temperature of the furnace, controlling the flow of the injected slurry.

Preferably, the system will have means of controlling the backwards and forwards motion of the air injection tube in the spray chamber, in order to prevent any clogging of the chamber with slurry.

In this way, the air injection tube and the diffuser will allow the spray chamber to be unblocked.

Advantageously, said injection means are provided with an air supply, fitted near the diffuser so as to protect same against radiant heat of the furnace.

The invention also concerns a procedure for operating such a system as has just been described, this procedure including an operating cycle beginning with a start up phase during which the supply of slurry from the spray chamber begins when a nominal supply of gas has been injected under pressure, and ending with a shut down phase during which the interruption in the supply of slurry from the chamber precedes commencement of a weak injection of air under pressure, at which time a cleaning fluid passes into the spray chamber and is evacuated by the slurry injection nozzle in the furnace.

During the shut down phase, a current of low pressure gas is therefore maintained, in order to prevent any risk of deterioration to the injection equipment by radiation. Furthermore, the cleaning phase is generally short and infrequent, lasting for two minutes every six hours for example.

The system in the invention can be used advantageously to incinerate slurry or same other pasty wastes such as fatty wastes from a used water treatment plant.

Preferably, the said slurry should receive at least a preliminary dehydration treatment prior to injection for incineration.

BRIEF DESCRIPTION OF THE DRAWINGS

Other characteristics and advantages of the invention will be discussed in the following description of a preferential mode of producing the invention, given by way of a non-limiting example, and in the drawings in the appendices, in which.

DETAILED DESCRIPTION

The invention therefore concerns a slurry injection system intended to be used in a dual purpose incineration furnace for household waste and slurry.

Figure 1:
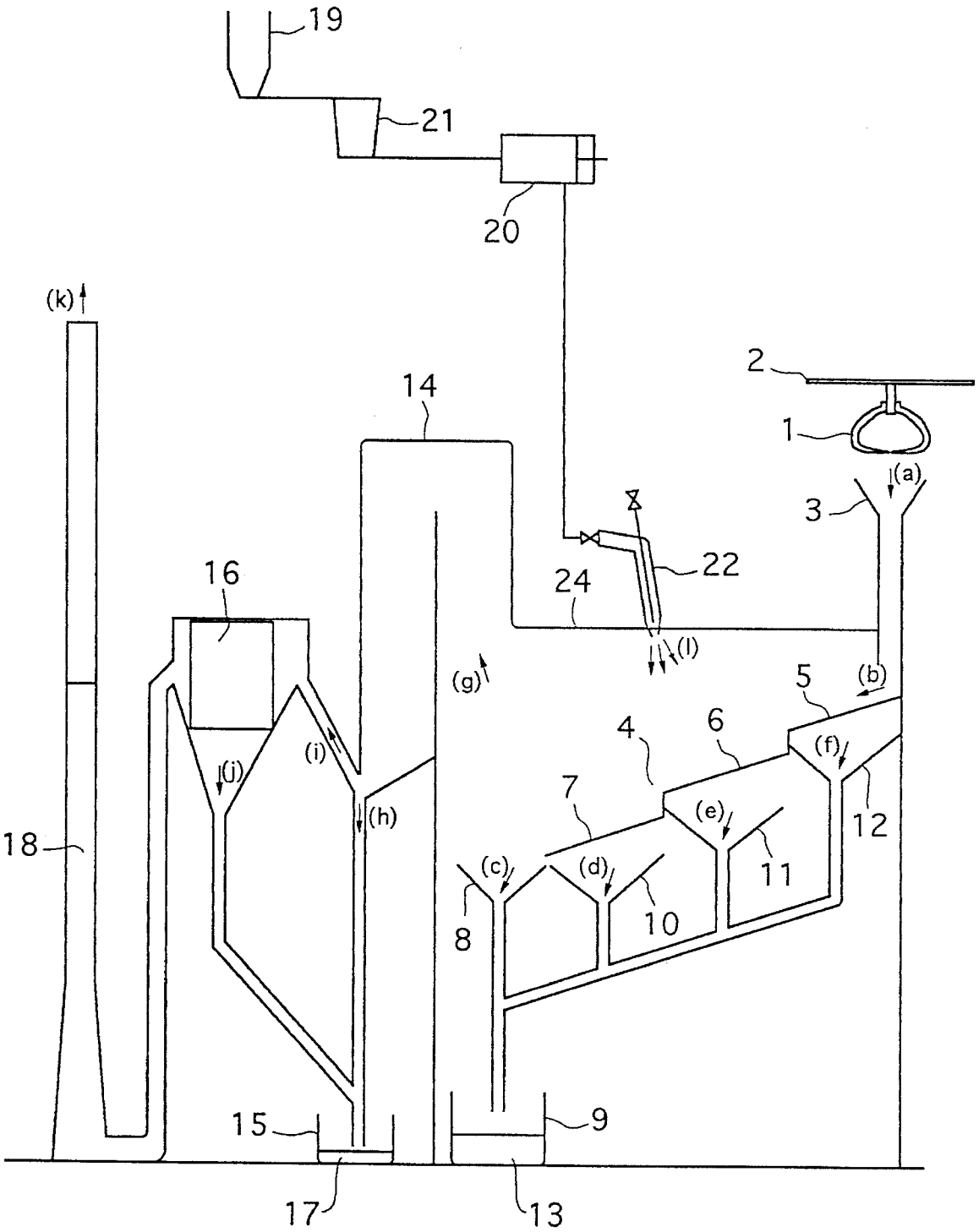
FIG. 1 shows a simplified diagram of a dual purpose incineration furnace for household waste and slurry in which a slurry injection system is used in accordance with the invention.

Such a furnace, a simplified diagram of which is shown in FIG. 1, is in fact a classic household waste incineration furnace to which a slurry injection system is added.

A grip 1 fixed to a furnace crane 2 takes household waste from a storage pit (not shown) and tips them (a) into a feed hopper 3. This household waste is placed (b) onto incineration hearth 4.

In this classic example, the incineration hearth 4 has three successive zones (or steps) each composed or rollers:

a drying zone 5 for household waste, intended to facilitate future combustion of them;

a combustion zone 6; and a finishing zone 7.

Once the household waste has been placed on this incineration hearth, clinker is obtained 13 which is collected (c) using a discharge hopper 8, in a bucket 9 (or any other means of storage) in order that they may be removed.

Other discharge hoppers 10, 11, 12, may also be provided underneath the various zones 5, 6, 7 of incineration hearth 4, so as to collect (d), (e), (f) the clinker which crosses through this hearth 4.

The incineration of household waste, mainly in combustion zone 6, not only produces clinker 13 but also smoke containing loose cinders. Generally, this smoke (g) crosses through an energy recuperation boiler 14. At the exit to this boiler 14, a portion of the loose cinders 17 are collected (h) in a bucket 15 and the resulting fumes are reprocessed (i), in an electro-filter 16 for example. This electro-filter 16 enables (j) the loose cinders 17 to be collected whereas the filtered fumes are evacuated (k) via a chimney 18.

Therefore the invention consists of injecting slurry into this furnace without appreciably disturbing the thermal equilibrium of the furnace, or even the operating balance of the furnace (in principle a household waste incineration furnace produces energy in the form of vapour, even electricity, which is resold to the client).

The slurry generally originates from a used water filtering plant and has been through a dehydration process, for example, using mechanical means of the band elimination or centrifugal decanting type. The level of dryness of this dehydrated slurry is between approximately 13 and 40% in a volume of free water, typically between 20 and 30%. Hereafter, we shall consider that the slurry is dehydrated. however, it is clear that the invention concerns the incineration of all types of slurry.

The slurry injection system has a back up silo 19, means of drawing off 20, a supercharge hopper 21 and means of injection 22.

The means of drawing off 20 are, for example, composed of a volumetric pump of thick material type.

The dehydrated slurry, stored in the back up silo 19, are removed by this volumetric pump 20 and fed to the injection device with no risk of there being any pockets of air.

The injection device 22 is fitted onto a wall 24 of furnace (arch or lateral wall), in such a way as to feed the slurry to be incinerated by gravity to incineration hearth 4. More precisely, the slurry is injected (1) onto the bed of household waste resting on this hearth 4. Therefore, the slurry is incinerated along with the household waste.

Additionally, these injection devices 22 are fitted with spray devices. Therefore, the slurry arrives at the hearth in the form of droplets. The spraying of the slurry is optimised and clogging is prevented because of the water. This enables drying to take place and complete combustion of the slurry by increasing the exchange surface between the combustible material (the slurry) and the oxygen carrier (the oxygen in the air) in the combustion chamber. Consequently, operation of the furnace is not disturbed (no overheating or under cooling), not greatly influencing the amount of non burned material in the clinker 13 and in the loose cinders 17.

In this example, the injection devices 22 are situated prominently in combustion zone 6. It is clear that these injection devices 22 may also be situated prominently in drying zone 5.

Additionally, in FIG. 1, the injection devices 22 constitute a single injector. The invention is not limited to this mode of production but also relates to the existence of several injectors. In this instance, the expert will be capable of choosing the number of injectors required as well as the spaces to be left between two successive injectors, in particular as a function of the flow and the nature of the slurry injected, of the surface area of incineration hearth 4, etc . . . .

Figure 2:
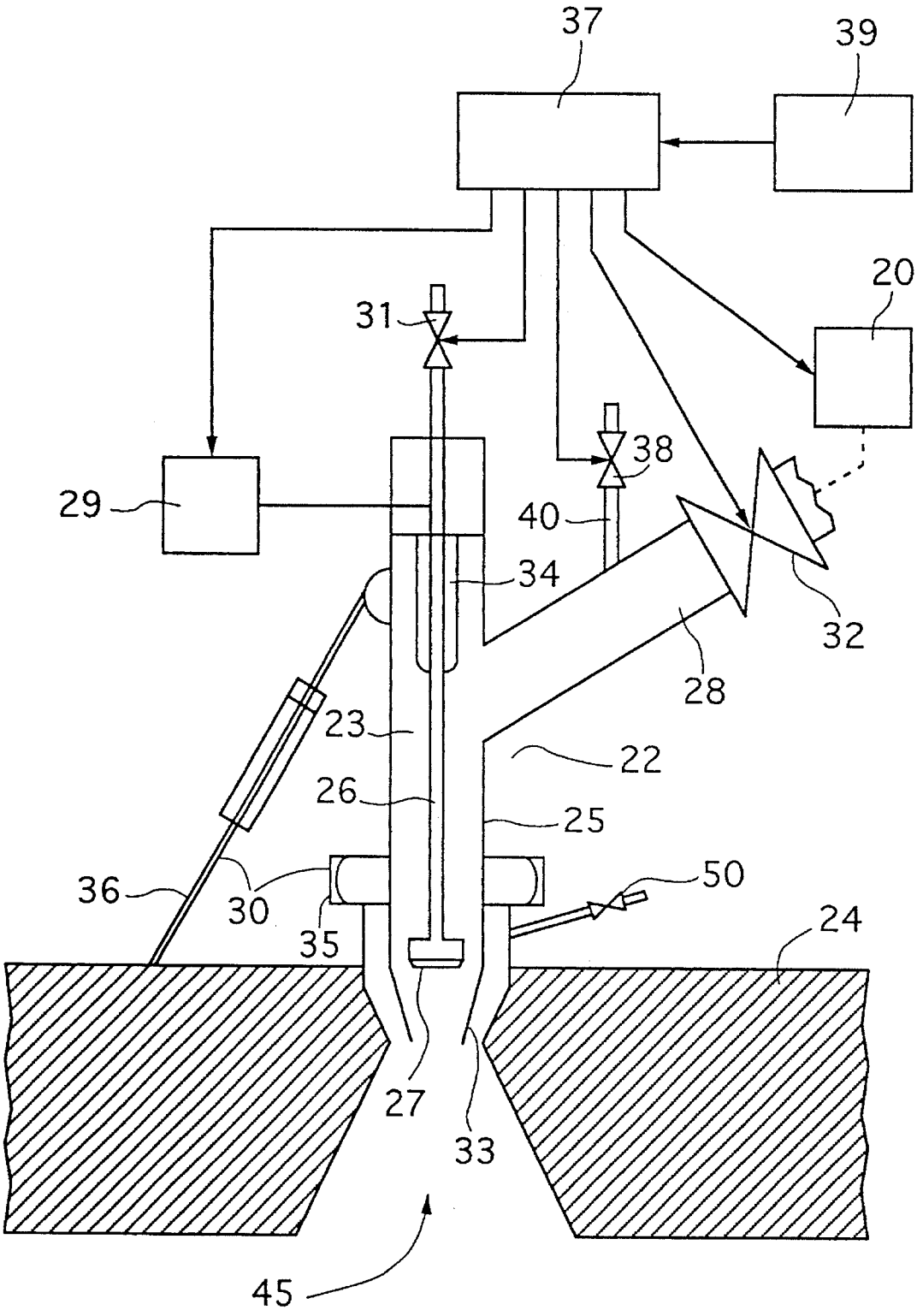
FIG. 2 shows a diagram of the preferred mode of producing the slurry injection system shown in FIG. 1.

FIG. 2 shows a diagram of the preferred mode of production of the slurry injection system.

In this preferred mode of production, the injection devices 22 have an injection casing 25 forming a spray chamber 23 which has a slurry feed entrance 28 and a discharge nozzle 33 to inject the slurry into the furnace.

The tube 50 is provided to inject permanently a low pressure gas, such as air, in order to protect the tip of the injector against radiant heat of the furnace.

Therefore, the tube 26 may be moved longitudinally within the chamber 25 using these displacement devices 29, which enables modification of the angle of the opening for diffusing the slurry droplets or slabs. Such longitudinal displacement means (backwards and forwards motion) also enables the chamber to be unblocked if necessary. These displacement devices are for example, composed of a wheel linked to the tube 26 to be used manually, or even a motorised device for moving the tube with the possibility to memorize the position. According to backwards and forwards motions of the diffuser, the diffuser protrudes of the nozzle when in the lower position. Though it is possible to clear efficiently the chamber.

In accordance with the invention the injection devices 22 are mounted onto a directable device 30. This device 30 is composed of a pivot 35 onto which an injection casing 25 is fitted and telescopic adjustment rods for tilting the injection casing 25 in relation to the hearth 4 of the furnace. With the device 30, it is possible to precisely position the injection means prior to use the furnace.

The discharge nozzle 33, a profile of which is shown here, does not totally crossed the wall 24 of the furnace, which avoids the slurry to be injected from being heated and dried by thermal transfer in the injection casing 25. The expert will be able to calculate the size of the angle for the injection hole 45.

The spray chamber 23 is crossed by a gas pressured injection tube 26, the end of which is fitted with a diffuser 27, located in the area of the nozzle 33.

The gas injection tube 26 is linked, via a valve 31, to devices (not shown) to supply pressurised gas. The injection casing 25, forming the chamber 23 inside which the gas injection tube 26 is placed is linked, via a valve 32, to the piston positive displacement volumetric pump 20.

When the slurry flows into the chamber 23, it is sprayed out, in the form of fine droplets, by the gas coming out of the diffuser 27.

The gas injection tube may be fitted with a protective sleeve 34, limiting abrasion to the tube, and the diffuser may be chamfered, avoiding any fibres contained in the slurry from becoming attached.

According to the invention, the injection system has a displacement device 29 for moving the diffuser 27 in relation to the nozzle 33.

Figure 3:
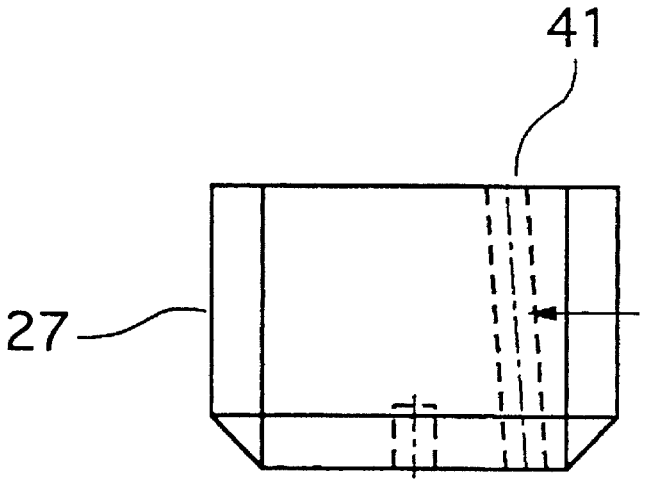
FIGS. 3 and 4 show the diffuser of the system according to FIG. 2.
Figure 4:
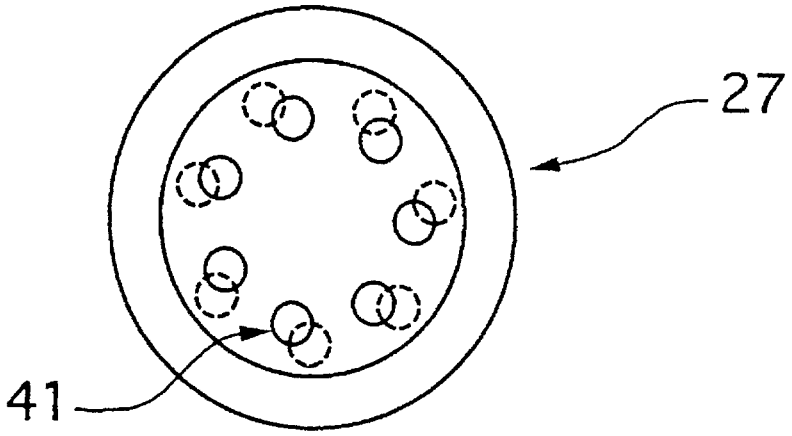

According to FIGS. 3 et 4, the diffuser 27 has for examples 7 holes 41 equally spaced apart and showing an inclination of 5° according two different axis, for giving an helical motion to the gas in order to efficiently dividing the slurry.

The overall adjustment of the injection devices 22 and particularly installation of them in a particular furnace (regarding its form and dimensions), and for a particular quality of slurry, therefore involves calculation of the following:

the position of the gas injection tube 26 in the injection casing 25;

the injection gas pressure and its flow rate; and the angle of the injection devices 22 in relation to the furnace hearth.

For example, an initial cold adjustment may be carried out, inspecting the angle on the spray cone from the injection device, in such a way that the slurry droplets do not hit the side walls of the furnace by being dispersed onto a large surface area of the incineration hearth. Then, the position of the tube, the gas pressure and the angle of the injection device from this initial adjustment are memorized. Then a second adjustment is made when the furnace is hot, possibly by carrying out a visual inspection of the injection and/or by inspecting the quantity of non burned material in the clinker and the loose cinders.

In a variation of production of the invention, it could be possible to vary the angle of the injection device even during the spraying process. This way, a trcansversal or longitudinal distribution of the slurry projection area could be effected (and/or of the cleaning fluid), which would enable a larger area to be used for incineration purposes, or enable the load of slurry to be distributed in time and space (or the cleaning fluid) distributed to the different zones of the incineration hearth.

The procedure for starting up the injection system includes the following successive stages:

gas input valve 31 is opened, until nominal gas pressure and/or gas flow rate is achieved;

slurry feed valve 32 is opened;

piston positive displacement volumetric pump 20 is started up (slurry feed).

The procedure for shutting down the injection system is comprised of the following stages:

piston positive displacement volumetric pump 20 is turned off;

slurry feed valve 32 is closed;

gas input valve 31 is partially closed until a low gas pressure is reached (and not a nil value), in such a way as to prevent any risk of damaging the injection device 22 by radiation.

The system operates completely automatically at start up and when switched off. However, it is clear that these procedures may also be initiated manually.

It should be noted that the injection casing 25 may have a cleaning fluid intake 40 (rinsing water for example), linked to an intake valve 38 which may be also controlled by automatic means of control 37. By placing the cleaning fluid intake 40 in the area of slurry feed intake 28, the whole of the spray chamber may be cleaned by injection nozzle 33. In this instance, the shut down procedure includes an additional stage, preceding the stage during which air intake valve 3 is partially closed, and consisting, for a predetermined period, of opening the cleaning fluid intake valve 38.

By linking the diffuser displacement device 29 to the controls (this corresponding to the automatic control device 37), the injection casing 25 may also be cleaned automatically (as soon as a blockage is detected, or periodically, as a prevention).

The system may also have means of controlling the internal temperature of the furnace, in such a way as to enable adjustment of operation of the furnace, which means that the slurry output is controlled at this temperature.

For example, these control stages shall be such that the output of slurry is:

nil when the internal temperature of the furnace is lower than a minimum predetermined temperature for operation of the furnace (850° C. for example);

equal to a maximum value (1600 kg of wet slurry per hour for example) when the internal temperature of the furnace exceeds a high predetermined value for operation of the furnace (1100° C. for example).

In order to improve the quality of the control, couples of intermediary values may also be calculated, and for example, notably;

an output of 400 kg of wet slurry per hour for a temperature of 900° C.;

an output of 1200 kg of wet slurry per hour for a temperature of 1000° C., which corresponds to the nominal regime for slurry between 20% and 30% of dryness (this output may be modified depending on the level of dryness).

The quantities of slurry which may be injected into a dual purpose household waste/slurry furnace depend on local constraints. Therefore, for a furnace with an incineration capacity of 100 tons of household waste per day (wet), 10 to 20% of slurry dehydrated to between 20% and 30% dryness, or 10 to 20 tons of wet slurry per day. However, these values are only examples, and may be reviewed and increased or decreased, in particular as a function of the main objective of the furnace. In certain instances the volume of slurry could be in the order of that of the household waste, even greater.

Prototypes of the injector have been produced and tested and have validated the effectiveness of the invention. The prototype had a spray chamber with an internal diameter of 80 mm, and a working length of approximately 300 mm. The diameter of the discharge nozzle on the injector was in the order of 50 mm. We were able to inject outputs of slurry in the order of 400 to 1600 kg per hour on site with this injector by injecting air at a rate of 20 to 100 $Nm^3$ per hour, at a pressure of approximately 1 to 3 bars. The size of the drops obtained from the injector was estimated at being in the order of 2 to 5 mm and preferably ought not to exceed a maximum of 15 to 20 mm approximatively.

We claim:

1. A system for injecting slurry or other pasty wastes to be incinerated into an incineration furnace, the furnace having an incineration hearth on which household waste is deposited in order to be incinerated, the system comprising:

an injection device for injecting the slurry to be incinerated into the furnace, the injection device being essentially situated above the incineration hearth to feed the slurry to the hearth at least in part by gravity, the injection device including, a slurry spray device for spraying the slurry as the slurry is injected into the furnace, an injection casing forming a spray chamber having a slurry feed intake and a discharge nozzle provided to inject the slurry into the furnace, a pressurized gas injection tube provided within the spray chamber and having a first end, which is fitted with a diffuser, provided in an area of the discharge nozzle of the spray chamber, and a displacement device coupled to the pressurized gas injection tube to displace the diffuser in relation to the discharge nozzle to provide adjustment of the slurry spray.

2. A system according to claim 1, wherein that the incineration hearth has at least two separate successive zones, including a combustion zone and a finishing zone, and wherein the injection device is essentially located above the combustion zone.

3. A system according to claim 1, wherein the incineration hearth has at least three separate successive zones, including a drying zone, a combustion zone and a finishing zone, and wherein the injection device is essentially situated above the drying zone and the combustion zone.

4. A system according to claim 1, wherein the injection casing is mounted onto a pivot and is coupled to a telescopic adjustment rod for adjusting an angle of the injection casing by rotating around the pivot.

5. A system according to claim 4, wherein the injection tube is covered at least partially with a protective sleeve.

6. A system according to claim 5, wherein the spray chamber is fitted with a cleaning fluid intake.

7. A system according to claim 6, wherein the cleaning fluid intake is located in an area of the slurry feed intake to allow the entire spray chamber to be cleaned prior to evacuation of cleaning fluid introduced by the cleaning fluid intake through the injection nozzle.

8. A system according to claim 7, further comprising a device for controlling an internal temperature of the furnace, and for controlling an output of the injected slurry.

9. A system according to claim 8, further comprising a device for controlling repeated backward and forward displacement of the air injection tube in the spray chamber to dislodge slurry blocking the spray chamber.

10. A system according to claim 9, further comprising a device for varying an angle of the injection device during the spraying operation, to allow for cyclical cleaning of the slurry projection area.

11. A system according to claim 10 wherein said injection device is provided with an air supply fitted near said diffuser.

12. An incineration furnace fitted with a system in accordance with claim 1.

13. A dual purpose incineration furnace for incinerating household waste and slurry fitted with a system in accordance with claim 1.

14. A process of incinerating slurry type wastes in an incineration furnace having an incineration hearth on which household waste is deposited and having an injection device situated so as to feed slurry to the incineration hearth, the process comprising the steps of:

feeding slurry to a spray chamber of the injection device;

feeding the slurry through the spray chamber past a gas injection tube having a diffuser formed on an end thereof;

feeding the slurry to a discharge nozzle of the injection device to discharge a slurry spray; and adjusting the slurry spray exiting the discharge tube by moving the diffuser of the gas injection tube relative to the discharge nozzle.

15. A process according in claim 14, wherein an operating cycle of the incineration furnace begins with a start up phase in which the feeding of slurry to the spray chamber is carried out after a step of establishing a nominal regime of pressurized gas and ends with a shut down phase during which an interruption in feeding of slurry to the spray chamber precedes the establishment of a weak regime of pressurized gas, and wherein the shut down phase is preceded by a cleaning phase in the spray chamber, in which a cleaning fluid passes into the spray chamber and is evacuated by the discharge nozzle into the furnace.

16. A process according to claim 14, wherein the slurry type waste comprises slurry from a water treatment plant.

17. A process according to claim 16, wherein the slurry from the water treatment plant has undergone at least a partial preliminary dehydration treatment prior to being fed into the spray chamber.

* * * * *